US005794676A

United States Patent [19]

Shattuck

[11] Patent Number: 5,794,676

[45] Date of Patent: Aug. 18, 1998

[54] DETACHABLE BRIEFCASE ORGANIZER

[76] Inventor: John Hunt Shattuck, 7730 Moritz Lake Dr., Corpus Christi, Tex. 78413

[21] Appl. No.: 639,624

[22] Filed: Apr. 29, 1996

[51] Int. Cl.[6] ..... A45C 11/26; A45C 11/34; A45C 11/36

[52] U.S. Cl. ..... 150/131; 190/110; 190/901; 206/214

[58] Field of Search ..... 150/143, 145, 150/131; 190/11, 114, 110, 109, 901; 206/214

[56] References Cited

U.S. PATENT DOCUMENTS

| | | | |
|---|---|---|---|
| 398,669 | 2/1889 | Starkey | 206/214 X |
| 539,682 | 5/1895 | Greves | 206/214 |
| 597,481 | 1/1898 | Graham | 206/214 |
| 766,308 | 8/1904 | Wilhelm | 206/214 |
| 1,849,771 | 3/1932 | Smith et al. | 206/214 |
| 2,520,176 | 8/1950 | Stanley | 150/145 X |
| 4,301,898 | 11/1981 | Plough et al. | 190/152 |
| 4,386,642 | 6/1983 | Durbin | 190/114 X |
| 4,555,018 | 11/1985 | Cho | 206/214 |
| 4,682,691 | 7/1987 | Spiering | 206/373 |
| 4,747,490 | 5/1988 | Smith | 206/542 |
| 4,901,901 | 2/1990 | Reitenour | 190/11 X |
| 4,951,811 | 8/1990 | Lines | 150/143 X |
| 5,018,609 | 5/1991 | Brenner | 190/108 |
| 5,115,893 | 5/1992 | Terkildsen | 190/11 |
| 5,160,001 | 11/1992 | Marceau | 190/102 |
| 5,366,070 | 11/1994 | Wolov | 206/214 |
| 5,413,198 | 5/1995 | Ferris | 190/1 |
| 5,423,363 | 6/1995 | Matzdorff et al. | 150/143 |
| 5,423,404 | 6/1995 | Shaw | 190/102 |
| 5,447,215 | 9/1995 | Volkmar et al. | 190/11 |

FOREIGN PATENT DOCUMENTS

| | | | |
|---|---|---|---|
| 115179 | 5/1942 | Australia | 206/214 |

OTHER PUBLICATIONS

Sporty's Pilot Shop Catalog, April through Jul. 1996 edition; p. 13; Accessory Organizer.

Crew Gear Catalog, Spring 1996 edition; p. 11 and K, Flight Case & Pilot Pak.

Crew Gear Catalog, Fall 1995 edition; pp. 24 and 25, Flight Cases.

*Primary Examiner*—Sue A. Weaver

*Attorney, Agent, or Firm*—Greenlee, Winner and Sullivan, PC

[57] ABSTRACT

The present invention provides a detachable organizer with a fastener for securing the organizer closed and/or for securing the organizer to a target surface, such as the interior surface of the closure flap of a flight case or a litigation briefcase. Alternatively, the organizer can be secured to a wall, countertop, desktop or dashboard or the like. For use by aircraft flight crew personnel, the interior of the organizer comprises a plurality of pockets adapted for receiving and securely holding small necessary items, including passport, small pocket calculator, flight log and expense record, pens and/or pencils, mini-flashlight and the FAA-approved folding multipurpose tool unit (e.g., the Leatherman tool). The preferred fastener by which the organizer is secured closed and attached to the target surface is hook-loop material, and preferably the organizer can be reversibly secured to the target surface in the closed or opened configuration.

7 Claims, 3 Drawing Sheets

DETACHABLE BRIEFCASE ORGANIZER

THE FIELD OF THE INVENTION

The present invention is in the area of portable, detachable organizers, for example for use in briefcases, especially for use by pilots in their flight cases.

THE BACKGROUND OF THE INVENTION

Pilots are required to carry certain small items including a small flashlight (for example, a Mini Maglight® flashlight, trademark of Mag Instruments, Inc., Ontario, Calif.), pens, pencils and highlighters, an earpiece for HF/VHF communications and a folding multipurpose tool, such as that made by Leatherman. Small logbooks for recording time and expenses are also carried. Where international travel is involved, the flight crew must also carry passports and other small items for documentation of various kinds.

Flight cases such as those currently used by pilots are relatively large briefcase-like carriers, with top flaps which fold over the top opening and latch to close the case. Those cases on the market include those with flaps with no organizer spaces to hold the small necessary items and those cases with permanently attached, closable pouches to hold small items. Unfortunately, those with the permanently attached pouches are oriented such that if the flap is in the vertical position and the closure of the pouch is not fastened, the opening is directed downward and any small items therein can spill out into the large cargo space in the interior of the case.

Because the folding multipurpose tool and the flashlight are items which are advantageously close at hand, especially if there were a crisis during a flight or at other times on the aircraft, there is a need for a means for securing these items in a location convenient for quick access. Often, these necessary items are loose in the bottom of the large cargo space of the flight bag, and they may be underneath other larger items, making accessibility untimely.

Because the flight crew may exit the airplane at intermediate or destination locations, it is desirable that they be able to detach an organizer so that passports and the like can be carried in compact cases which could fit into a jacket pocket or a purse.

Some prior art organizers/carriers have adhesive or hook-loop material strips to which tools or pencils which carry the complementary form of the hook-loop material, for example in strips around their circumferences or patches attached to flat surfaces thereof, are secured. The present invention is distinguished in that there is no need to attach adhesive or hook-loop material to the articles to be carried in the organizer.

The present invention fills a longfelt need in the art for a convenient, user-friendly organizer for carrying small, necessary items, where the organizer is of a size sufficiently small to be carried in a pocket or purse.

SUMMARY OF THE INVENTION

The present invention provides a compact, detachable organizer case for securely carrying small items, including but not limited to, small tools, folding multipurpose tool such as that made by Leatherman (Portland, Oreg.), Gerber (Portland, Oreg.) or SOG (Edmonds, Wash.), a mini-flashlight, pens and pencils, a molded earpiece, and a passport, flight log/expense record and a small pocket calculator. The interior of the flexible folding organizer contains pockets in sizes adapted to accept and securely hold the desired items. The exterior of the organizer has a plurality of fastening means for closing the organizer and for reversibly attaching the organizer to a target surface (preferably a flat surface) by means of complementary fastening means to be affixed to the target surface. Reversible attachment can be via fastening means including, but not limited to, magnetic strips, snaps or hook-loop material, preferably Velcro (registered trademark of Velcro, Co.). Alternatively, the fastening means by which the organizer is attached to the target surface can be permanent in nature (stitching, adhesive, heat-welds or rivets). Optionally, there is a pocket on the exterior of the organizer, on the segment which includes the fastening means to which the closure flap is secured, having a width substantially the same as the organizer (or edged by the seam or weld of the binding, if any, and a seam or weld at the bottom edge of the pocket material, across the width of the organizer). The top, open edge of this pocket is substantially even with the fastening means and a small distance below the top edge of the organizer. It is understood that this exterior pocket could be located on the other large segment; however, the preferred location is where the contents are protected by the closure flap when the organizer is in the closed position.

DETAILED DESCRIPTION OF THE INVENTION

As specifically exemplified, the detachable briefcase organizer is designed for use by airline personnel to allow quick access to each required small item carried in their flight bags, or by corporate, light-airplane or pleasure pilots, by mounting the organizer on any surface that is compatible.

Figure 1:
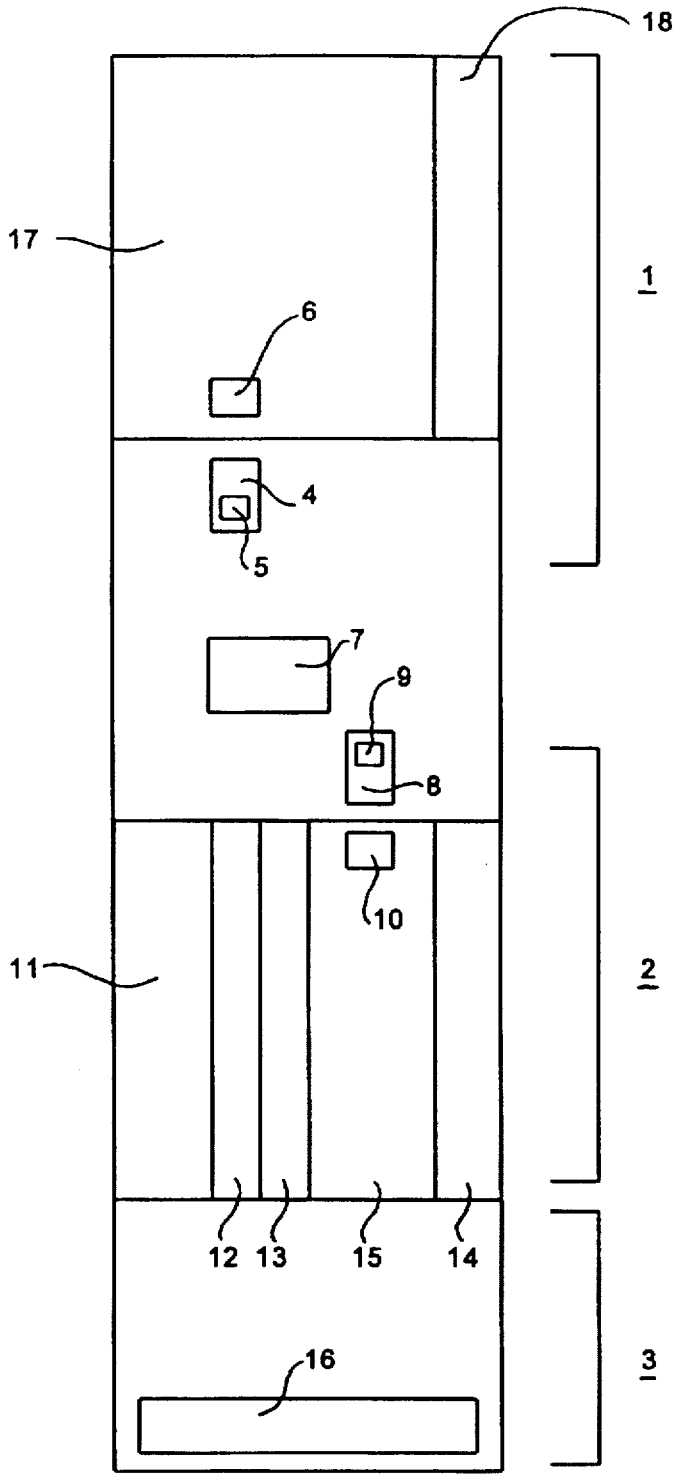
FIG. 1 illustrates the interior of the organizer, in the specifically exemplified embodiment designed for the needs of aircraft flight deck personnel, in its opened and flat configuration.

FIG. 1 illustrates the interior of the organizer, in the specifically exemplified embodiment designed for the needs of aircraft flight deck personnel, in its opened and flat configuration. 1 is a first large segment, with its pocket or large compartment 17 designed to hold a passport, small pocket calculator up to 3.25×5 inches, flight crew log/expense record and/or the like. This compartment is secured closed by a small tab 4 with a first fastening means 5 on the lower surface of the tab and a complementary fastening means 6 on the exterior of the pocket 17 in a location adapted to mate with the first fastening means 5, small pocket 18 of a size and shape adapted to receive an oblong object such as a pen or pencil. A channel formed by material 7 is located on the interior surface at the region of the organizer where it folds between the first and second large segments (1 and 2,) respectively). A second large segment 2 comprises a plurality of pockets formed to hold oblong objects such as pens or pencils, a mini-flashlight and a folded multipurpose tool such as the FAA-approved Leatherman tool or the like. Tool pocket 15 can be secured closed by means of a tab 8 which has a first fastening means 9 which mates with a complementary fastening means 10 on the outside of the pocket. Tool pocket 15 can be reduced in depth by a seam across its width so as to hold the tool for an easy access; pockets 12, 13 and 14 are oblong, and each is of a size and shape adapted for holding a pen, pencil, or the like. Pocket 11 is of a size and shape adapted to hold a small flashlight, such as the Mini Maglight® (registered trademark of Mag Instruments, Inc.). Preferably, the plurality of pockets on this segment of the organizer are formed of a single piece of material, and the pockets are separated from one another by stitching, or other means of permanent attachment as appropriate to the materials of the pocket and the interior surface of the organizer. Closure flap 3 can be secured closed by means of a fastening means 16 when the organizer is folded closed via complementary fastening means on the exterior surface of large segment 1 (fastening means 21, see FIG. 2).

Figure 2:
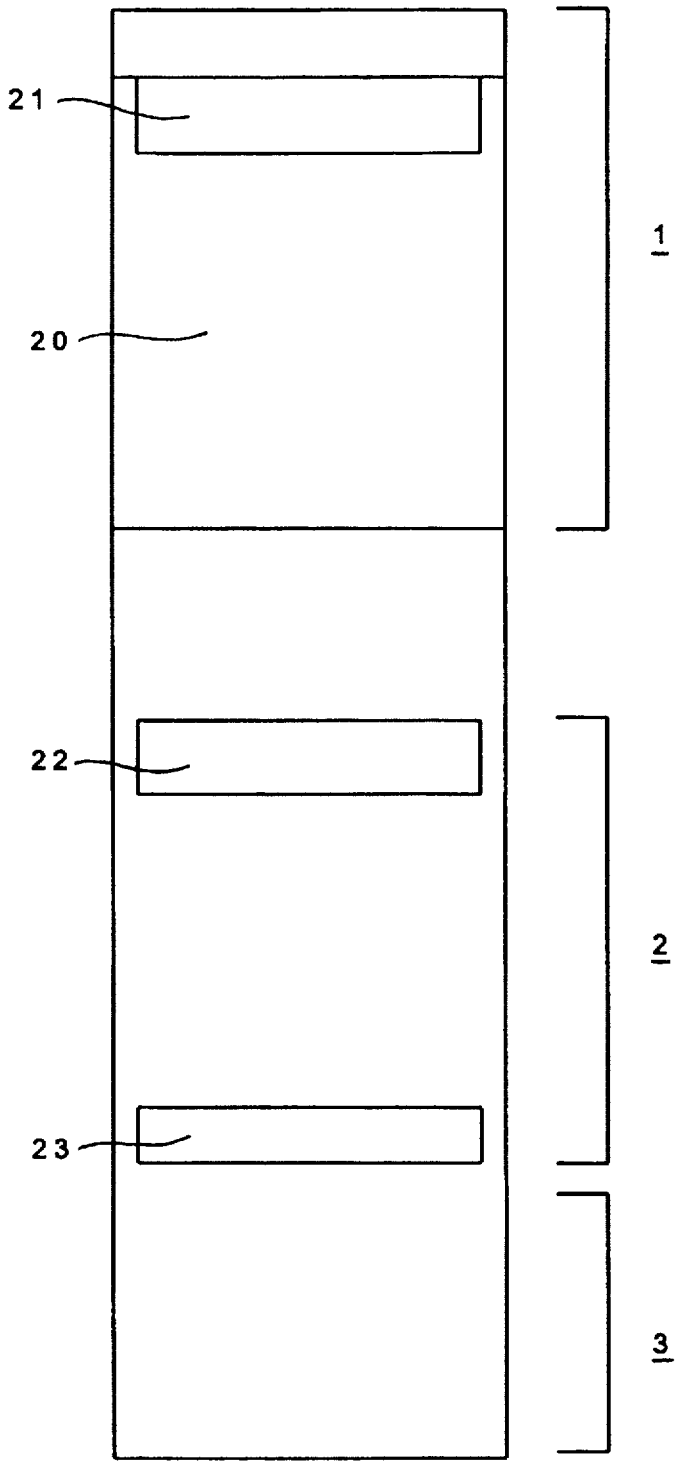
FIG. 2 illustrates the exterior surface of the specifically exemplified organizer in the opened, flat configuration.

FIG. 2 illustrates the exterior surface of the organizer in the opened, flat configuration. Fastening means strips (21, 22 and 23) are shown in the preferred positions. The region labeled 3 is the exterior surface of the closure flap and corresponds to the first large segment shown in FIG. 1, and the region labeled 2 is the exterior surface of the second large segment also labeled 2 in FIG. 1. Exterior pocket 20 has a width substantially the same as the organizer and preferably edged by the seam or weld of the binding, if any, and a seam or weld at the bottom edge of the pocket material, across the width of the organizer. The top, open edge of this pocket is substantially even with the fastening means 21 and a small distance (about 0.5 to 0.75 inch as specifically exemplified) below the top edge of the organizer.

Figure 3:
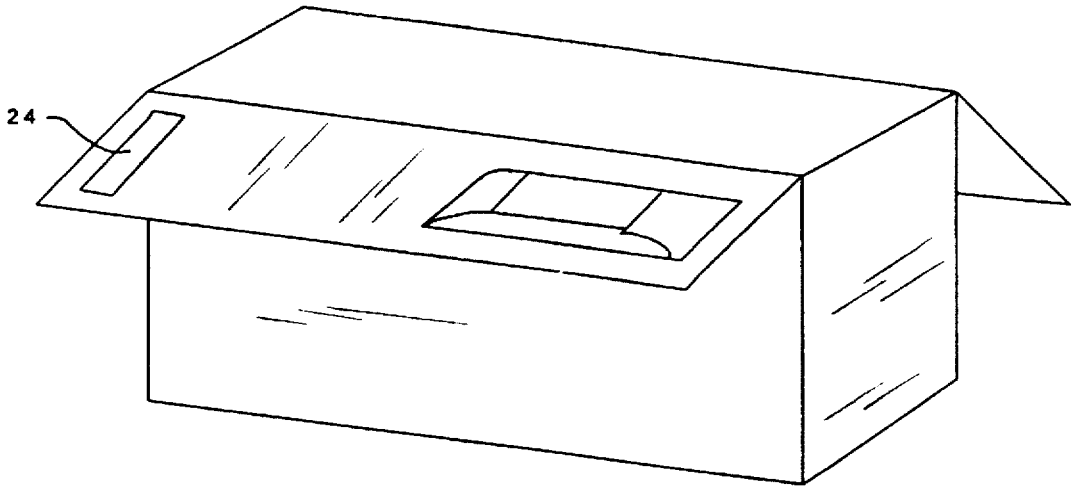
FIG. 3 illustrates the interior surface of the closure flap of an open flight case or litigation briefcase with the exemplified closed organizer case attached.

FIG. 3 illustrates the interior surface of the closure flap of an open flight case or litigation briefcase with the organizer attached thereto in the closed configuration. Fastening means 24 is complementary to the fastening means 21 on the exterior of region 1 (see FIG. 2) when the organizer is opened flat on the interior of the flight case or briefcase closure flap.

The detachability of the present organizer allows the user to carry his or her small items and documentation in a compact case on his or her person, or in a purse or other relatively compact carrier, apart from a large and heavy case. The arrangement of attachment means on the outer surface of the organizer allows the user to place complementary attachment means on the inner surface of the briefcase flap so that the organizer can be reversibly affixed in the flat, opened configuration or secured in the closed configuration.

The present organizer is preferably constructed of a durable, flexible material which does not stretch, such as Cordura woven material (500 denier nylon, trademark of Dupont, (Wilmington, Del.). Alternative materials include leather, plastic or fabric. It is preferred that the material be water-and stain-resistant. There can be, between the inner and outer surfaces of the organizer, one or more internal layers which provide some stiffening, ridigity and thickening of the organizer while allowing the organizer to fold at the desired places. This internal material can be a flexible foam with resistance to crushing; alternatives are readily apparent to the skilled artisan.

The means for fastening the organizer to a surface, preferably a flat surface, can include rivets, pins with fasteners, snaps, magnetic strips, double-sided adhesive, and hook-loop materials where one of the hook-loop pair is placed on the target surface and the other is placed on the organizer. A preferred hook-loop material is Velcro® (registered trademark of Velcro, Co.). In a kit comprising a detachable organizer case and means for fastening the kit to a target surface, there is advantageously a sealed packet containing an alcohol-impregnated wipe for cleaning the target surface to which the organizer is intended to be affixed, and an adhesive strip protected by a release liner and complementary material in a strip array on the outer surface of the organizer. It is preferred that the fastening means portion on the target surface be the hook portion and the fastening means portion on the exterior of the organizer be the soft loop portion of the hook-loop material to minimize abrasion of skin or clothing or adherence to clothing, upholstery or the like.

Optionally, the organizer can be edged with a binding of wear-resistant material, for example, nylon. The binding can alternatively be constructed from leather, plastic or other durable, flexible material permanently attached to the organizer.

On one large section of the interior surface of the organizer is a large compartment formed of a durable, flexible, stretch-resistant material, woven or otherwise as set forth above for the exterior surface. The large compartment (see FIG. 1) is sub-divided, for example by stitching, into a narrow and a wide pocket. The narrow pocket 18 is designed to accept an oblong object such as a pen or pencil. The wider pocket 17 is designed to accept relatively flat materials and is advantageously shaped to accept a passport, pocket calculator up to about 3.25"×about 5", a crew flight log and expense record book, or the like. For security, the wide pocket can be advantageously secured with a tab closure 4 by means of a fastening means, for example, a snap-type closure or hook-loop material such as Velcro (registered trademark of Velcro, Co).

On the interior surface of the organizer, in the relatively central fold region, there is optionally a channel 7 for accepting a relatively narrow object not longer than the width of the organizer, and optionally designed to hold the molded earpiece carried by the flight deck personnel of an aircraft for HF/VHF communications (see FIG. 1). This channel can be formed of a strip of material, such as a flexible, stretch-and wear-resistant fabric, plastic or leather, and is sewn, glued or heat-welded into place, as appropriate for the materials joined, so that the ends of the material parallel to the long edges of the opened organizer are open so as to accept an article in the channel.

On the second large section (2 in FIG. 1) on the interior of the organizer, pockets are formed, for example by stitching or in the case of a plastic-type material, by heat bonding. Suitable materials are as described hereinabove for the compartments associated with the first large section of the organizer. In a preferred configuration, pocket 11 is designed to accept a small flashlight (e.g., Mini Maglight®, trademark of Mag Instruments, Inc., which is about 5 inches long and about 0.5–1.0 inches in diameter on the handle portion and is powered by two AA batteries). Preferably there are two to three additional pockets formed (12, 13, 14 in FIG. 1) which are designed to accept oblong objects such as pencils or pens. Finally, there is an additional pocket 15 of dimensions suitable for accepting and holding securely a folded multiple purpose tool, such as that made by Leatherman or its alternatives and approved by the Federal Aviation Administration for use by airline personnel. This tool includes flat and Phillips screwdrivers, and pliers, all of which are required for airline flight deck crews. The closed, compact tool is about 4.25 inches long, 0.625 inch thick and about 1.25 inches wide. Other tools meeting this purpose are made by Gerber and SOG and have similar dimensions. Because these tools are expensive, the pocket made to accept the multipurpose tool is secured with a tab-type closure 8 as described hereinabove for the closure of the compartment suitable for carrying a passport. In cases where the depth of tool pocket 15 allows the tool to enter the pocket without leaving enough of the tool to allow easy withdrawal by an exposed end, the tool pocket is advantageously shortened by securing the material to the main panel of the organizer by stitching or the like.

The third section (3 in FIG. 1) of the interior surface of the opened organizer is the portion which serves as the closure flap of the organizer. On the interior surface is a fastening means 16. The fastening means can be a snap-type or a magnetic closure or, more preferably, hook-loop material, and it mates with a complementary fastening means on the exterior of the case at the opposite end of the main panel (21 in FIG. 2).

On the outer surface of the opened organizer, there are fastening means at a plurality of locations (see FIG. 2). A fastening means 21 at one end is complementary to the fastening means portion located on the interior surface of what becomes the closure flap when the unit is closed. When in the closed position, there are one or more fastening means portions located on the exterior surface of the closed unit opposite the closure flap side. These fastening means 22 and 23 have complementary fastening means portions on the target surface to which the organizer is to be detachably affixed, for example on the interior of a flight case closure flap. Where hook-loop material is the fastening means, strips thereof are permanently attached to the organizer, preferably stitched thereon.

Optionally, there is a pocket 20 on the exterior of the organizer (see FIG. 1), on the segment 1 which includes the fastening means 21 to which the closure flap is secured, having a width substantially the same as the organizer (or edged by the seam or weld of the binding, if any, and a seam or weld at the bottom edge of the pocket material, across the width of the organizer). The top, open edge of this pocket is substantially even with the fastening means and a small distance (as specifically exemplified, about 0.5 to 0.75 inches) below the top edge of the organizer. This distance below the top edge must allow the fastening means 16 on the bottom surface of the closure flap 3 to mate with the complementary fastening means 21 on the exterior of the organizer, i.e., on the exterior surface of the pocket thereon. The fastening means 21 is attached to the exterior of the pocket. It is understood that this exterior pocket could be located on the other large segment; however, the preferred location is where the contents are protected by the closure flap when the organizer is in the closed position. This pocket is formed of material secured to the long edges of the main panel and across the edge of the pocket toward the central region of the main panel. It is understood that the exterior pocket could be narrower than the exemplified width which is substantially the width of the organizer main panel, but maximum width is preferred.

Desirably, the target surface has affixed to it fastening means portions which are complementary to fastening means 22 and 23 on the exterior surface of the organizer and in positions which allow attachment. Advantageously, there is a third fastening means portion complementary to the fastening means portion located on the exterior surface of the first large segment and located on the target surface such that when the organizer is affixed and opened, it can be secured to the target surface in the open position for the convenience of the user (see FIG. 3, fastening means 24). The fastening means on the organizer serves to mate with the closure flap fastening means when the organizer is in the closed configuration.

When the organizer is sold, it is desired that it be sold in kit form so as to allow the user to apply fastening means, preferably in three counterparts, to the target surface, whereby the organizer unit can be attached or removed as desired and so that the organizer can be affixed in the closed position or secured flat in the opened configuration for ready access to the contents. When hook-loop material serves as the fastening means, it is desired to have the portions destined for the target surface attached by the hook-loop interaction to the compatible portions on the organizer. Those portions destined for the target surface are preferably coated with adhesive material to which a release liner is affixed. To install the organizer and the fastening means destined for the target surface, the organizer is opened flat, the release liners are removed from the outer surfaces of the fastening portion to be attached to the target surface, and the flat organizer is pressed onto the target surface so as to adhere the appropriate portion of the hook-loop material to the target surface. Where adhesive-coated strips of fastener material are used, it is preferred that the target surface first be cleansed with an alcohol-impregnated wipe to remove any oily residue which would diminish adherence. Then the organizer is released from the portion of the hook-loop material adhered to the target surface, if desired.

Alternate fastening means for attaching the organizer to a target surface include one or more clips permanently attached to the organizer and having a compatible surface on the target surface into which the clips can be slipped. Alternatively, clips could be used to attach the organizer to the edge of the briefcase or flight case flap. Snaps or compatible magnetic strips positioned on the organizer and target surface so as to allow attachment can also be used to detachably affix the organizer to the target surface. Where detachment is not desired, relatively permanent fastening means can include rivets or double-sided adhesive tape of a strength sufficient to hold the organizer in place over a long period of time. The advantage of the hook-loop fastener is that exact placement is not as critical as with snaps, it is readily available commercially and the attachment mediated by it is strong relative to the weight and bulk of the material.

Although the bulk of the discussion related to the configurations of the compartments, etc. on the interior of the organizer case relates to design for the convenience of flight deck personnel, the art will recognize that alternate arrangements and sizes of pockets and channels can be adapted for use by others for whom organization and holding of small articles on a target surface, such as the interior of the closure flaps of a case (such as the large litigation briefcases carried by attorneys and business people needing relatively large cargo capacity in a briefcase-type carrier). The detachability allows the user to transfer the organizer from one case to another or from one target surface to another, as convenient, or simply to keep valuable or necessary items at hand when carrying something as large as a briefcase is not desired. The detachable nature of the present invention allows greater flexibility and convenience of use than organizers which are an integral part of a briefcase or other carrier.

In a particularly preferred embodiment, the closed, filled organizer has dimensions of about 7.25 inches by about 5.5 inches by about 1.5 to about 2.5 inches. The main panel of the organizer is about 5.5 inches by about 17.5 inches in the opened and flat configuration. It is understood that other sizes can be used, provided that the organizer folded in place on the flight bag or briefcase closure flap does not interfere with the closing of the flight bag or briefcase.

The disclosure is provided for illustrative purposes, and is not intended to limit the scope of the invention as claimed herein. Any variations in the exemplified articles which occur to the skilled artisan are intended to fall within the scope of the present invention.

I claim:

1. An organizer case providing means for holding in place small items required by pilots which can be configured in a flat opened arrangement or which can be folded into a closed configuration, said organizer case comprising:

a main panel having a top edge, a bottom edge, and two side edges, and having an interior surface and an exterior surface, wherein said main panel has a first fold region and a second fold region perpendicular to the side edges, a first large segment between the top edge and the first fold region, a second large segment between the first fold region and the second fold region, and a closure flap portion between the third fold region and the bottom edge;

a first plurality of pockets formed on the interior surface of the first large segment by a permanently attached material;

a strip of material attached to the interior surface of the main panel and perpendicular to the side edges of the main panel in the first fold region to form a channel;

a second plurality of pockets formed by material permanently attached to the interior surface of the second large segment, wherein attachment sites attaching the material to the interior surface of the second large segment divide one pocket from another;

a fastening means on the interior surface of the closure flap; and a plurality of fastening means fixedly attached to the exterior surface of the main panel, one of said fastening means being situated so as to join with the fastening means on the interior surface of the closure flap, another of said fastening means being situated so as to join with a complementary fastening means on a target surface.

2. The organizer case of claim 1 wherein one of said first or second plurality of pockets includes a first pocket having a size adapted for receiving an oblong object such as a pen or pencil, and a second pocket having a size suited for holding one or more objects including a passport, a small pocket calculator, and a small, pocket-sized logbook, and wherein the other of said first or second plurality of pockets includes five pockets, independently of one another adapted for holding oblong objects including pens, pencils, a mini-flashlight, and a compactly folded multipurpose tool, and wherein the material forming said plurality of pockets is durable and stretch-resistant.

3. The organizer case of claim 2 wherein the pocket having a size suited for holding one or more objects including a passport has a closure tab with a fastening means for securing the contents of said pocket.

4. The organizer case of claim 2 wherein the pocket adapted for holding a compactly folded multipurpose tool has a closure tab having an upper and a lower surface, said closure tab being attached to the interior surface of the main panel and wherein said closure tab has a fastening means to secure the contents of said pocket on the lower surface of said closure tab mating with a complementary fastening means on the exterior of said pocket.

5. The organizer case of claim 1 wherein there is a pocket formed on the exterior surface of the first large segment of said main panel, said pocket having a fastening means attached to its outer surface near its opening, said opening being oriented toward said bottom edge of said main panel and said pocket having a depth not greater than the distance from the opening to the fold region of said main panel between the first and second large segments.

6. The organizer case of claim 1 wherein said fastening means are hook-loop fastening material.

7. The organizer case of claim 1 wherein the material forming said pockets and wherein the interior and exterior surfaces of the main panel are 500 denier nylon material.

* * * * *